US009250598B2

(12) United States Patent
Matsuo et al.

(10) Patent No.: US 9,250,598 B2
(45) Date of Patent: Feb. 2, 2016

(54) IMAGE FORMING APPARATUS WITH AN ARC-SHAPED DUPLEX FEED PATH HAVING INCREASED RADIUS OF CURVATURE

(71) Applicant: Panasonic Corporation, Osaka (JP)

(72) Inventors: Kazunori Matsuo, Fukuoka (JP); Shunichi Itai, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/192,563

(22) Filed: Feb. 27, 2014

(65) Prior Publication Data

US 2015/0030365 A1 Jan. 29, 2015

(30) Foreign Application Priority Data

Jul. 25, 2013 (JP) ..... 2013-154258

(51) Int. Cl.

| | |
|---|---|
| ***G03G 15/00*** | (2006.01) |
| ***B41J 13/00*** | (2006.01) |
| ***G03G 15/23*** | (2006.01) |
| ***B65H 85/00*** | (2006.01) |
| ***B65H 5/38*** | (2006.01) |

(52) U.S. Cl.

CPC ..... *G03G 15/6555* (2013.01); *B41J 13/0045* (2013.01); *B65H 5/38* (2013.01); *B65H 85/00* (2013.01); *G03G 15/234* (2013.01); *G03G 15/6579* (2013.01); *B65H 2301/3114* (2013.01); *B65H 2404/52* (2013.01); *B65H 2601/255* (2013.01); *G03G 15/6561* (2013.01); *G03G 2215/0043* (2013.01)

(58) Field of Classification Search

CPC ..... G03G 15/6579; G03G 15/234; G03G 2215/0043; G03G 2215/00586; B65H 2301/3114; B65H 85/00; B41J 13/0045

USPC ..... 399/401

See application file for complete search history.

(56) References Cited

U.S. PATENT DOCUMENTS

| | | | |
|---|---|---|---|
| 4,727,398 | A | 2/1988 | Honjo et al. |
| 4,811,049 | A | 3/1989 | Honjo et al. |
| 6,078,760 | A | 6/2000 | Abe et al. |
| 6,185,380 | B1 | 2/2001 | Abe et al. |
| 6,782,236 | B2 * | 8/2004 | Sasaki et al. ..... 399/401 |

(Continued)

FOREIGN PATENT DOCUMENTS

| | | |
|---|---|---|
| JP | 61-183032 A | 8/1986 |
| JP | 11-035210 A | 2/1999 |

(Continued)

*Primary Examiner* — Justin Olamit

(74) *Attorney, Agent, or Firm* — Seed IP Law Group PLLC

(57) ABSTRACT

Disclosed is an image forming apparatus capable of preventing a paper jam in an arc-shaped sheet passing path for turning around a sheet and transporting the sheet in a double-sided transporting path. In this apparatus, a double-sided sheet passing path is formed so as to include: an arc-shaped interval that causes the sheet to turn around and to be transported to a registration sensor on an upstream side in the transport direction of a sheet and that includes the registration sensor as one end point; and an interval that transports the sheet having passed between ADU transport rollers, obliquely downward. A single-sided sheet passing path is formed so as to include an interval that transports the sheet having passed over the registration sensor in a substantially horizontal direction.

9 Claims, 3 Drawing Sheets

(56) References Cited

U.S. PATENT DOCUMENTS

| | | | | |
|---|---|---|---|---|
| 7,548,722 | B2 * | 6/2009 | Tsuji | 399/401 |
| 7,760,216 | B2 * | 7/2010 | Tseng et al. | 347/139 |
| 2011/0158725 | A1 | 6/2011 | Asada et al. | |

FOREIGN PATENT DOCUMENTS

| | | | |
|---|---|---|---|
| JP | 2011-136831 | A | 7/2011 |
| JP | 2012-101906 | A | 5/2012 |
| JP | 2012-152919 | A | 8/2012 |

* cited by examiner

IMAGE FORMING APPARATUS WITH AN ARC-SHAPED DUPLEX FEED PATH HAVING INCREASED RADIUS OF CURVATURE

BACKGROUND OF THE INVENTION

1. Field of the Invention

The present invention relates to an image forming apparatus including a double-sided printing function.

2. Description of the Related Art

In recent years, image forming apparatuses such as a multifunction printer (MFP) including functions of a printer, a copying machine, FAX, and the like have been in widespread use. The image forming apparatuses generally include almost all functions necessary to complete office work, are compact, do not take up too much space, and are also excellent in terms of costs. Thus, the widespread use of these image forming apparatuses is expected to increase.

In addition, some image forming apparatuses include the double-sided printing function which forms an image on one side of a printing sheet and thereafter forms an image on the reverse side of the printing sheet (for example, see PTL 1). In the double-sided printing, an image is also formed on the reverse side by forming an image on one side of the printing sheet in an image forming section and then feeding and reversing the sheet to a double-sided sheet passing path to feed the sheet again into the image forming section.

CITATION LIST

Patent Literature

PTL 1

Japanese Patent Application Laid-Open No. HEI 11-35210

During the double-sided printing, it is expected that, in the sheet passing path in which, after an image is formed on one side of a sheet in the image forming section, the sheet is delivered to the double-sided sheet passing path and reversed and is delivered to the image forming section again, the radius of curvature of an arc shape of a sheet passing path for turning around the transport direction of the sheet decreases with a reduction in size of the image forming apparatus.

If the radius of curvature of the arc shape decreases, a sheet with high stiffness does not turn around along the arc-shaped sheet passing path when the sheet passes along the arc-shaped sheet passing path, and a paper jam is likely to occur in this case. Conversely, even if a sheet with low stiffness is used, the sheet cannot smoothly pass along the arc-shaped sheet passing path and is bent, which likely causes a paper jam.

SUMMARY OF THE INVENTION

The invention has been made in consideration of the above-described situation, and an object of the invention is to provide an image forming apparatus capable of suppressing the occurrence of a paper jam of a sheet in an arc-shaped sheet passing path.

An image forming apparatus according to an aspect of the invention is an image forming apparatus that forms an image on one side of a recording medium by an image forming section and then forms an image on another side of the recording medium, the apparatus including: a first sheet passing path that transports the recording medium housed in a sheet-feeding tray to the image forming section; and a second sheet passing path that reverses the recording medium with an image formed on one side and causes the recording medium to join the first sheet passing path, in which: the first sheet passing path includes, on a downstream side in the transport direction of the recording medium from a joining position with the second sheet passing path, a horizontal transporting path that transports the recording medium from the joining position in a substantially horizontal direction; and the second sheet passing path includes, on an upstream side in the transport direction of the recording medium from the joining position with the first sheet passing path: an arc-shaped sheet passing path that causes the recording medium to turn around and to be transported to the joining position; an obliquely downward sheet passing path that transports the recording medium to the arc-shaped sheet passing path obliquely downward; and a horizontal sheet passing path that transports the recording medium substantially horizontally to the obliquely downward sheet passing path and that includes transport rollers at both ends of the horizontal sheet passing path.

According to the present invention, it is possible to increase the radius of curvature of the arc-shaped sheet passing path and to suppress the occurrence of a paper jam of a recording medium in the arc-shaped sheet passing path.

DESCRIPTION OF THE EMBODIMENTS

Hereinafter, an embodiment of the present invention will be described in detail with reference to the drawings.

[Configuration of Image Forming Apparatus]

Figure 1:
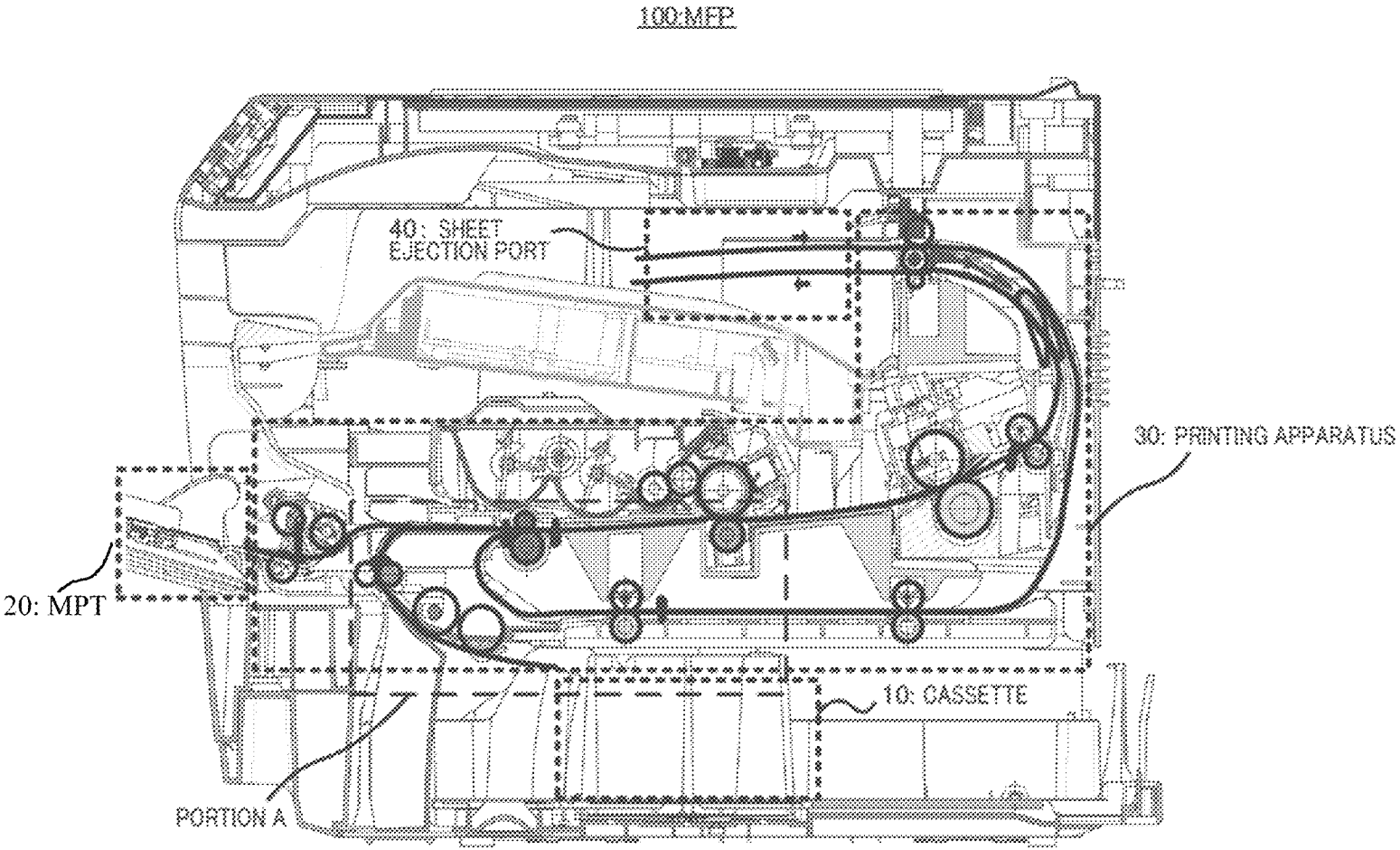
FIG. 1 is a sectional view showing the configuration of an image forming apparatus according to an embodiment of the invention.

FIG. 1 is a sectional view showing the configuration of image forming apparatus (MFP) 100.

Image forming apparatus 100 takes out a recording medium (hereinafter referred to as "sheet") housed in cassette (sheet-feeding tray) 10 or multi-purpose tray (MPT) (manual sheet-feeding tray) 20, delivers the recording medium to printing apparatus 30, prints image data on the sheet in printing apparatus 30, and ejects the sheet on which the image data is printed to sheet ejection port 40.

[Configuration of Printing Apparatus 30]

Figure 2:
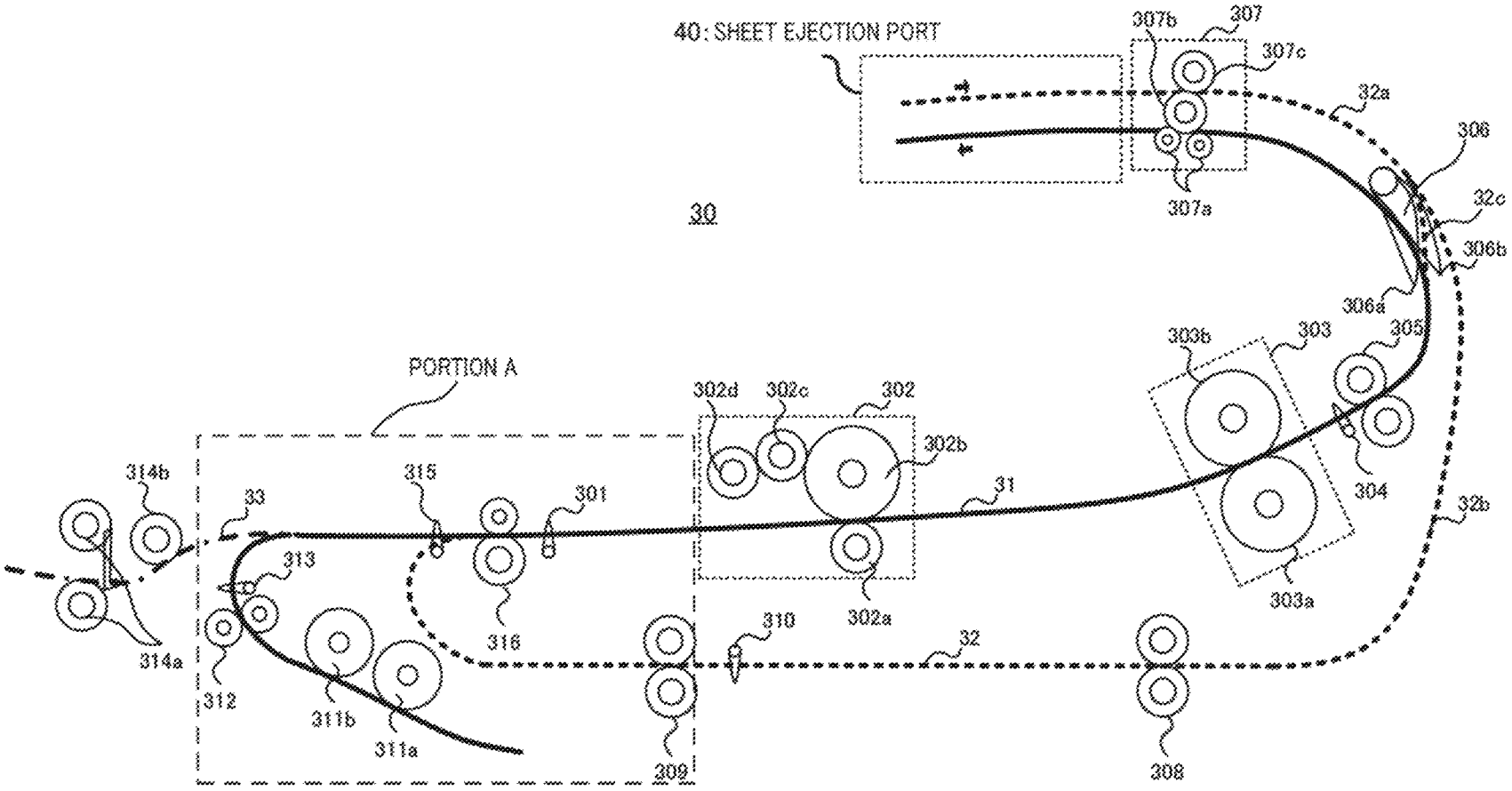
FIG. 2 is a diagram showing the configuration of a printing apparatus in the embodiment of the invention.

FIG. 2 is a conceptual diagram of printing apparatus 30 in FIG. 1. Printing apparatus 30 includes a double-sided printing function which forms an image on one side of a sheet (recording medium) and thereafter forms an image on the other side of the sheet.

Printing apparatus 30 shown in FIG. 2 has single-sided sheet passing path 31 (solid line), double-sided sheet passing path 32 (broken line), and MPT sheet passing path 33 (one-dot-chain line) as a sheet passing path along which the sheet is transported.

Single-sided sheet passing path 31 is a transporting path along which the sheet is transported during single-sided printing or double-sided printing, and is a transporting path along which sheet feeding, image formation, fixation, and sheet ejection are performed.

Double-sided sheet passing path 32 is a sheet passing path along which the sheet is transported during double-sided printing. Double-sided sheet passing path 32 includes sheet passing path 32*a* for reversing (switchback) sheet, sheet passing path 32*b* for allowing the reversed sheet to join single-sided sheet passing path 31 again, and sheet passing path 32*c* for feeding the sheet into sheet passing path 32*b* from single-sided sheet passing path 31.

MPT sheet passing path 33 is a transporting path along which the sheet is transported from MPT 20 to single-sided sheet passing path 31.

Top sensor 301 detects whether or not a sheet is passing over top sensor 301. Specifically, top sensor 301 generates an OFF signal when no sheet is passing over top sensor 301 and generates an ON signal when a sheet is passing over top sensor 301.

Image forming section 302 includes transfer roller 302*a*, OPC (Organic Photo Conductor) 302*b*, developing roller 302*c*, and supply roller 302*d*. Image forming section 302 transfers a toner image according to image data to the transported sheet, thereby forming an image on the sheet.

Fixing section 303 includes pressing roller 303*a* and heating roller 303*b*. Fixing section 303 fixes the toner image transferred to the sheet.

Sheet ejection sensor 304 detects whether or not a sheet is passing over sheet ejection sensor 304. Specifically, similarly to top sensor 301, sheet ejection sensor 304 generates an OFF signal when no sheet is passing over sheet ejection sensor 304 and generates an ON signal when a sheet is passing over sheet ejection sensor 304.

Sheet ejection roller 305 is placed at a position subsequent to fixing section 303 and transports the transported sheet in the direction of switching lever 306.

Switching lever 306 is a switching lever configured to turn around an axis and including a guide extending from the axis toward image forming section 302 and switches the transportation destination of the sheet transported by sheet ejection roller 305 to any one of single-sided sheet passing path 31 and double-sided sheet passing path 32. In a state where switching lever 306 is at position 306*a*, the sheet is transported in the direction of ejection section 307 on sheet passing path 32*c*. On the other hand, in a state where switching lever 306 is at position 306*b*, the sheet is transported in the direction of ejection section 307 on single-sided sheet passing path 31.

Ejection section 307 includes rollers 307*a*, 307*b*, and 307*c* placed in proximity to sheet ejection port 40. Rollers 307*a* and roller 307*b* constitute an ejection roller that ejects a sheet transported on single-sided sheet passing path 31 to sheet ejection port 40. Additionally, roller 307*b* and roller 307*c* constitute a reverse roller (switchback roller) that reverses the transport direction of the sheet transported on double-sided sheet passing path 32 (sheet passing path 32*a*).

In the following description, the rotation processing of rollers 307*a*, 307*b*, and 307*c* when the sheet transported on single-sided sheet passing path 31 is ejected to sheet ejection port 40 is referred to as "forward rotation processing," and rotation processing reverse to "forward rotation processing" is referred to as "reverse rotation processing." That is, in the forward rotation processing, a sheet on single-sided sheet passing path 31 is transported by roller 307*a* and roller 307*b* in the direction in which the sheet is ejected to sheet ejection port 40, and a sheet on sheet passing path 32*a* is transported by roller 307*b* and roller 307*c* in the direction of sheet passing path 32*b*. On the other hand, in the reverse rotation processing, sheet on sheet passing path 32*a* is transported by roller 307*b* and roller 307*c* in the direction in which the sheet is ejected to sheet ejection port 40.

That is, during the double-sided printing, first, ejection section 307 pulls the sheet transported on sheet passing path 32*c* to sheet passing path 32*a* by the reverse rotation processing of the reverse rollers (rollers 307*b* and 307*c*). Next, ejection section 307 transports the sheet on sheet passing path 32*a* in the direction of sheet passing path 32*b* by the forward rotation processing of the reverse rollers.

ADU (Automatic Duplex Unit) transport roller 308 and ADU transport roller 309 each include a pair of rollers, and each of the pairs of rollers is placed in an up-down direction. ADU (Automatic Duplex Unit) transport roller 308 and ADU transport roller 309 transport the sheet transported from ejection section 307 to sheet passing path 32*b* in the direction of single-sided sheet passing path 31. Since the two sides of the sheet that has joined single-sided sheet passing path 31 from sheet passing path 32*b* have been reversed, the double-sided printing is enabled in printing apparatus 30. ADU sensor 310 detects whether or not a sheet has passed over ADU sensor 310, thereby detecting that the sheet is being transported along sheet passing path 32*b*.

Pick roller 311*a* and separation roller 311*b* take out sheets one by one from cassette 10, and feed roller 312 delivers the taken-out sheet to single-sided sheet passing path 31. Pickup sensor 313 detects whether or not the sheet has passed over pickup sensor 313, thereby detecting that the sheet is taken out from cassette 10.

MPT pick roller 314*a* and MPT transport roller 314*b* take out sheets one by one from MPT 20, and delivers the taken-out sheet from MPT sheet passing path 33 to single-sided sheet passing path 31.

Registration sensor 315 detects whether or not a sheet has passed over registration sensor 315. Registration roller 316 corrects the leading end position of the sheet to be transported on the basis of a position detected by registration sensor 315. This allows an image to be printed and a fed sheet to be synchronized with each other.

[Configuration of Sheet Passing Path for Transporting Sheet to Top Sensor 301]

Figure 3A:
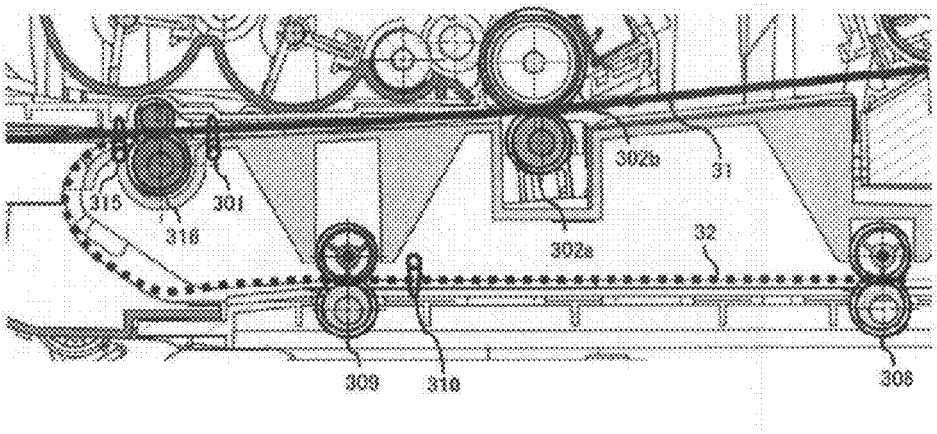
FIGS. 3A and 3B are an enlarged view of an image forming apparatus according to an embodiment of the invention and a diagram showing a moving trajectory of a sheet.
Figure 3B:
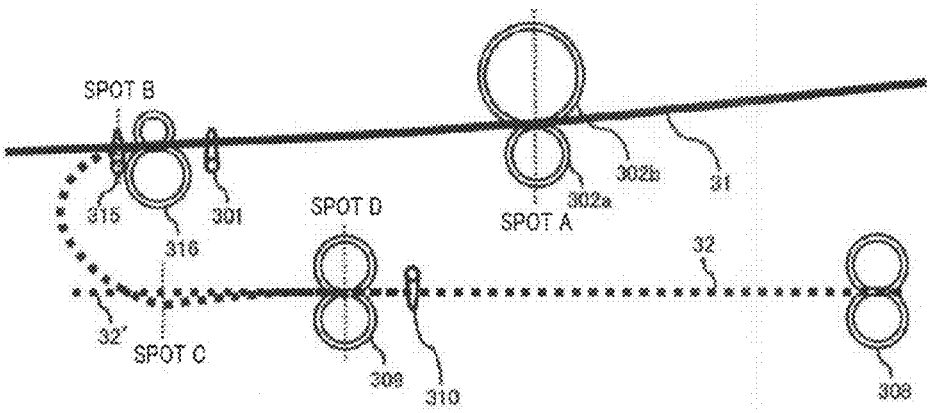

FIG. 3A is an enlarged view of double-sided sheet passing path 32 (portion A shown in FIG. 1 and FIG. 2) which reverses a sheet with an image on one side and causes the sheet to join single-sided sheet passing path 31. FIG. 3B shows a moving trajectory of a sheet to be transported in FIG. 3A.

Single-sided sheet passing path 31 shown in FIG. 3A and FIG. 3B is formed so as to include an interval (first interval) that transports the sheet having passed over registration sensor 315 between transfer roller 302*a* and OPC 302*b* of image forming section 302 in a substantially horizontal direction. Double-sided sheet passing path 32 is formed so as to include: an arc-shaped predetermined interval (second interval) that causes the sheet to turn around and to be transported and that includes registration sensor 315 as one end point; and an interval (third interval) that transports the sheet having passed between ADU transport rollers 309 to the second interval obliquely downward. Registration sensor 315 is placed near the joining position of single-sided sheet passing path 31 and double-sided sheet passing path 32.

Specifically, as shown in FIG. 3B, in single-sided sheet passing path 31, an interval between spot A and spot B is referred to as the first interval, and in double-sided sheet passing path 32, an interval between spot B and spot C is referred to as the second interval, and an interval between spot C and spot D is referred to as a third interval. Spot C is the spot of a lowermost portion in a vertical direction of double-sided sheet passing path 32 and is below trajectory 32' (dotted line) which is an extension line of the transporting path (substantially horizontal) between ADU transport roller 308 and ADU transport roller 309. That is, the third interval is an interval in which double-sided sheet passing path 32 is lowered toward a downstream side in the transport direction of the sheet, and which transports the sheet obliquely downward.

Spot A represents the placement position of transfer roller 302*a* and OPC 302*b*, spot B represents the placement position of registration sensor 315, and spot D represents the placement position of ADU transport roller 309. In the example of FIG. 3A and FIG. 3B, spot B is near a position where double-sided sheet passing path 32 joins single-sided sheet passing path 31, and a position where the sheet passing path is substantially linear and horizontal.

That is, the first interval is an interval that transports the sheet in the substantially horizontal direction with the placement position of registration sensor 315 placed near the joining position of single-sided sheet passing path 31 and double-sided sheet passing path 32 as one end point and the placement position of transfer roller 302*a* and OPC 302*b* as the other end point. The second interval is an arc-shaped interval that causes the sheet to turn around and to be transported and that includes one end point of the first interval as one end point and the position of the lowermost portion in the vertical direction of double-sided sheet passing path 32 as the other end point. The third interval is an interval which is lowered toward the downstream side in the transport direction of the sheet with the other end point of the second interval as one end point and the placement position of ADU transport roller 309 placed downstream of the other ADU transport roller 308 in double-sided sheet passing path 32 as the other end point. A fourth interval is an interval which transports the recording medium to the third interval in a substantially horizontal direction, and which includes the other end point of the third interval as one end point and includes ADU transport rollers 308, 309 at both ends thereof.

The third interval is lowered toward the downstream side in the transport direction of the sheet and is connected to the second interval at the position of the lowermost portion in the vertical direction of double-sided sheet passing path 32. One end point on the upstream side in the sheet transport direction of the arc-shaped second interval for turning the sheet around and transporting the sheet is located in the lowermost portion in the vertical direction of double-sided sheet passing path 32. Accordingly, it becomes possible to increase the radius of curvature of arc-shaped double sided sheet passing path 32 of the second interval compared to double-sided sheet passing path 32 in which the third interval is substantially horizontal, and to suppress the occurrence of a paper jam of the recording medium in double-sided sheet passing path 32 compared to the second interval in which the radius of curvature of arc-shaped double-sided sheet passing path 32 is small.

In the foregoing embodiment, although a case where a sheet is used as a recording medium has been described, the recording medium is not limited to a sheet, and any recording medium may be used insofar as the double-sided printing is possible.

The present invention is useful for an image forming apparatus which can perform double-sided printing.

INCORPORATION BY REFERENCE

The present application claims priority from Japanese application JP 2013-154258 filed on Jul. 25, 2013, the content of which is hereby incorporated by reference into this application.

The invention claimed is:

1. An image forming apparatus that forms an image on one side of a recording medium by an image forming section and then forms an image on another side of the recording medium by the image forming section, the apparatus comprising:

a first sheet passing path that transports the recording medium housed in a sheet-feeding tray to the image forming section; and a second sheet passing path that reverses the recording medium with an image formed on one side and causes the recording medium to reenter the first sheet passing path via a joining position at which the second sheet passing path meets the first sheet passing path, wherein:

the first sheet passing path includes, downstream of the joining position in a transport direction of the recording medium, a horizontal transporting path that transports the recording medium from the joining position in a substantially horizontal direction; and the second sheet passing path includes, upstream of the joining position:

an arc-shaped sheet passing path starting at a first spot to reverse the recording medium and to transport the recording medium in a reversed state to the joining position;

an obliquely downward sheet passing path starting at a second spot and ending at the first spot to transport the recording medium obliquely downwardly to the arc-shaped sheet passing path; and a horizontal sheet passing path starting at a third spot and ending at the second spot to transport the recording medium substantially horizontally to the obliquely downward sheet passing path, the horizontal sheet passing path including transport rollers at both ends at the third spot and the second spot, respectively, wherein a first distance between a level of the third spot of the horizontal sheet passing path and a lowest portion of the obliquely downward sheet passing path is shorter than a second distance between the level of the third spot of the horizontal sheet passing path and a lowest portion of the transport roller at the third spot, the lowest portion of the transport roller at the third spot defining a lowermost limit of all transport rollers included in the second sheet passing path, the first spot is located at a lowest portion of the second sheet passing path in a vertical direction, and at least a part of the horizontal sheet passing path is above the sheet-feeding tray.

2. An image forming apparatus that forms an image on one side of a recording medium by an image forming section and that forms an image on another side of the recording medium by the image forming section, the image forming apparatus comprising:

a first sheet passing path that transports the recording medium housed in a sheet-feeding tray to the image forming section; and a second sheet passing path that reverses the recording medium with an image formed on one side and that causes the recording medium to reenter the first sheet passing path via a joining position at which the second sheet passing path meets the first sheet passing path, wherein:

the first sheet passing path includes, downstream of the joining position in a transport direction of the recording medium, a first interval that transports the recording medium from the joining position in a substantially horizontal direction; and the second sheet passing path includes, upstream of the joining position:

an arc-shaped second interval starting at a first spot to reverse the recording medium and to transport the recording medium in a reversed state to the joining position;

a third interval starting at a second spot and ending at the first spot to transport the recording medium obliquely downwardly to the second interval; and a fourth interval starting at a third spot and ending at the second spot to transport the recording medium substantially horizontally to the third interval, the fourth interval including transport rollers at both ends at the third spot and the second spot, respectively, wherein the first spot at which the third interval ends and the second interval starts is located at a lowest portion of the second sheet passing path in a vertical direction, a first distance between a level of the third spot and the first spot is shorter than a second distance between the level of the third spot and a lowest portion of the transport roller at the third spot, the lowest portion of the transport roller at the third spot defining a lowermost limit of all transport rollers included in the second sheet passing path, and at least a part of the fourth interval is above the sheet-feeding tray.

3. An image forming apparatus that forms an image on one side of a recording medium by an image forming section and that forms an image on another side of the recording medium by the image forming section, the image forming apparatus comprising:

a first sheet passing path that transports the recording medium housed in a sheet-feeding tray to the image forming section; and a second sheet passing path that reverses the recording medium with an image formed on one side and that causes the recording medium to reenter the first sheet passing path via a joining position at which the second sheet passing path meets the first sheet passing path, wherein:

the first sheet passing path includes a first interval that transports the recording medium in a substantially horizontal direction from the joining position to a placement position of the image forming section in a transport direction of the recording medium; and the second sheet passing path includes:

an arc-shaped second interval starting at a first spot to reverse the recording medium and to transport the recording medium in a reversed state to the joining position;

a third interval starting at a second spot and ending at the first spot to transport the recording medium obliquely downwardly to the second interval; and a fourth interval starting at a third spot and ending at the second spot to transport the recording medium substantially horizontally to the third interval, the fourth interval including transport rollers at both ends at the third spot and the second spot, respectively, wherein the first spot at which the third interval ends and the second interval starts is located at a lowest portion of the second sheet passing path in a vertical direction, a first distance between a level of the third spot and the first spot is shorter than a second distance between the level of the third spot and a lowest portion of the transport roller at the third spot, the lowest portion of the transport roller at the third spot defining a lowermost limit of all transport rollers included in the second sheet passing path, and at least a part of the fourth interval is above the sheet-feeding tray.

4. The image forming apparatus according to claim 1, wherein the image forming section includes:

a transfer roller;

an organic photo conductor; and a developing roller, wherein the image forming section transfers a toner image according to image data to the transported recording medium to form an image on the recording medium.

5. The image forming apparatus according to claim 2, wherein the image forming section includes:

a transfer roller;

an organic photo conductor; and a developing roller, wherein the image forming section transfers a toner image according to image data to the transported recording medium to form an image on the recording medium.

6. The image forming apparatus according to claim 3, wherein the image forming section includes:

a transfer roller;

an organic photo conductor; and a developing roller, wherein the image forming section transfers a toner image according to image data to the transported recording medium to form an image on the recording medium.

7. The image forming apparatus according to claim 1, wherein the transport rollers each includes a pair of rollers placed as top and bottom rollers in the vertical direction.

8. The image forming apparatus according to claim 2, wherein the transport rollers each includes a pair of rollers placed as top and bottom rollers in the vertical direction.

9. The image forming apparatus according to claim 3, wherein the transport rollers each includes a pair of rollers placed as top and bottom rollers in the vertical direction.

* * * * *